US005204146A

United States Patent [19]

Heinze et al.

[11] Patent Number: 5,204,146

[45] Date of Patent: Apr. 20, 1993

[54] DECORATIVE CONTAINER AND METHOD FOR PREPARING SAME

[76] Inventors: Sally M. Heinze; Leda M. Borghese, both of 7227 Cascade Rd., Grand Rapids, Mich. 49546

[21] Appl. No.: 656,955

[22] Filed: Feb. 15, 1991

[51] Int. Cl.[5] ..... B65D 85/36

[52] U.S. Cl. ..... 428/7; 116/DIG. 9; 206/522; 428/9; 446/220

[58] Field of Search ..... 428/7, 9, 12; 446/220, 446/225, 226; 40/312; 206/423, 522; 116/DIG. 9

[56] References Cited

U.S. PATENT DOCUMENTS

| | | | |
|---|---|---|---|
| 2,748,256 | 5/1956 | Moran | 40/538 X |
| 3,835,308 | 9/1974 | Reese | 428/7 X |
| 4,145,838 | 3/1979 | Mason | 446/220 X |
| 4,811,841 | 3/1989 | Domenichiello | 206/522 X |
| 4,924,919 | 5/1990 | Oyler | 141/10 |
| 4,974,393 | 12/1990 | Rich et al. | 53/433 |

*Primary Examiner*—Henry F. Epstein
*Attorney, Agent, or Firm*—Price, Heneveld, Cooper, DeWitt & Litton

[57] ABSTRACT

A decorative container is disclosed having a transparent shell-like housing with an attached balloon which can be removably placed as a cover over an article. The balloon can be inflated by any of three methods including two negative pressure techniques and a positive pressure technique. In one of the negative pressure techniques, a space surrounding the balloon is evacuated while ambient air enters to expand the balloon. When the balloon is inflated, the housing is placed into the open throat of the balloon to seal the balloon. In the second negative pressure and the positive pressure techniques, the shell-like housing has a sealable air passage through which air can flow to inflate the balloon. The balloon can be inflated by evacuating a space around the balloon allowing ambient air to enter the balloon through the air passage in the housing. The air passage is then closed to seal the balloon. The balloon can also be inflated by passing pressurized air through the passage in the housing and then closing the passage when the balloon is inflated. The housing and inflated balloon can then be placed over an article forming a decorative container which can be removed and replaced on the article without deflating the balloon.

9 Claims, 1 Drawing Sheet

DECORATIVE CONTAINER AND METHOD FOR PREPARING SAME

BACKGROUND OF THE INVENTION

People have been presenting gifts to one another for many years wrapped in colored paper with decorative ribbons. The wrapped package is a beautiful sight to behold and it is a little disappointing that the wrapping has to be taken apart in order to see and receive the gift. Something as fragile as a decorated cake, for example, can be presented as a gift when placed in a box and suitably wrapped without danger that the appearance of the cake will be destroyed In the recent past a novel packaging scheme for a gift has been developed in which the gift is placed within an inflated balloon. The gift can then be seen through the wall of the balloon. In order to gain access to the gift, the balloon must be punctured during which process the elastic material snaps back violently. In view of the violent effects produced on puncturing the balloon, a balloon is unsuitable for wrapping a gift as fragile as a decorated cake unless special precautions are taken to protect the cake such as using a box or cover.

U.S Pat. No. 4,924,919 issued May 15, 1990, to Oyler entitled METHOD OF FILLING A BALLOON WITH ARTICLES AND AIR discloses a negative pressure method and apparatus for placing randomly shaped objects into a balloon. The entire teaching of this patent is incorporated herein by reference.

In the negative pressure method for expanding a balloon, the balloon is mounted in an enclosure which is partially evacuated. While the air is being evacuated from the enclosure, ambient air enters and expands the balloon. The article is placed in the inflated balloon and the balloon is tied off to confine the air and article.

Another technique for expanding a balloon not disclosed in the Oyler patent is the positive pressure technique in which air is blown into the throat of the balloon and the article is inserted as the air flows. This technique has so far been limited to rather small articles. A distinct advantage of the positive pressure technique, however, is that an enclosure is not needed to inflate the balloon.

SUMMARY OF THE INVENTION

The present invention relates to a decorative container including a housing having a balloon which substantially encloses the outer surface of the housing. The balloon can be inflated using either the negative or positive pressure technique. The combined housing and balloon enable a person to receive and view a gift. When the person wishes to gain access to the gift, the housing and balloon can be lifted off without damaging or deflating the balloon. The person can gain access to the gift, for example to cut a piece of cake, and then the housing and inflated balloon can be returned as a cover over the cake. According to the teaching of the present invention, large balloons can be inflated and used to contain very large, randomly shaped objects.

DETAILED DESCRIPTION OF THE PREFERRED EMBODIMENTS

Figure 1:
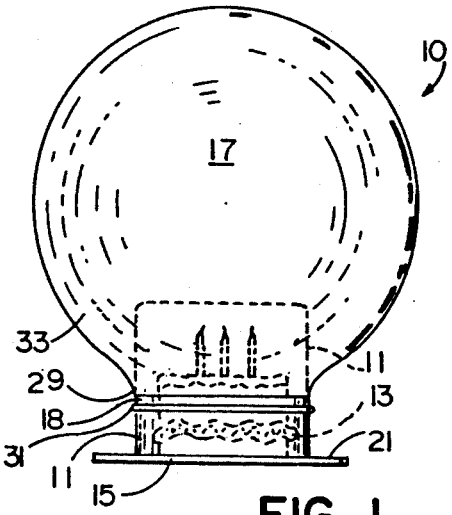
FIG. 1 shows a cake within the decorative container of the present invention.

Referring to FIG. 1, an embodiment of the decorative container of the present invention is shown and indicated generally by the number 10. The decorative container includes a preferably transparent shell-like housing member 11 which is used to cover the article 13 which, for purposes of illustration and not by way of limitation, is a cake. The housing member 11 is used to close the throat of the balloon. It is preferred to use some means such as an elastic band, elastic tape or a compatible adhesive material, either alone or in combination, to seal the balloon to the housing to prevent escape of the gas contained within the balloon. In FIG. 1, the throat of the balloon 17 is mounted on the housing 11 and then an elastic band 18 is placed over the balloon. A portion of the throat of the balloon can then be folded back over the elastic band 18 or rolled back with the elastic band 18 to complete the air-tight seal between the balloon and the housing. A decorative ribbon 19 (FIG. 2) can be wrapped about the housing and the edge of the balloon to conceal the means used to provide the air-tight seal. The gift item and decorative cover can be supported on a tray-like member 21.

Shell-like housing 11 is preferably made from a polymeric material such as polyvinyl chloride, polycarbonate, Mylar or any other of the many transparent polymeric materials. Housing 11 should be strong enough to be dimensionally stable. It is preferred that housing 11 be transparent so that the item enclosed within the balloon can be clearly seen; however, the present invention is not so limited. The housing can also be made of inorganic materials such as glass or metal. The housing can even be translucent to obtain a particular decorative effect.

Figure 2:
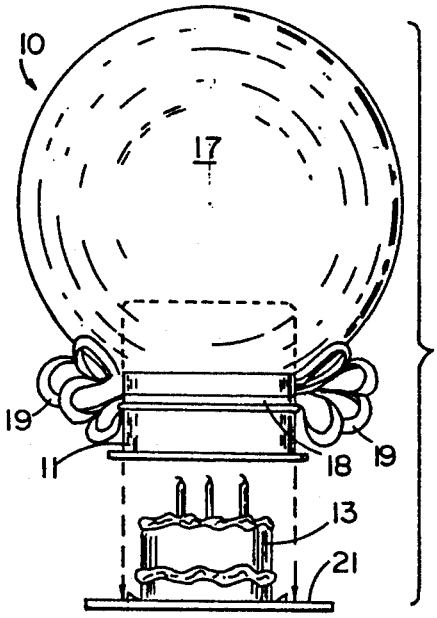
FIG. 2 shows the decorative container of FIG. 1 now opened to provide access to the cake.
Figure 3A:
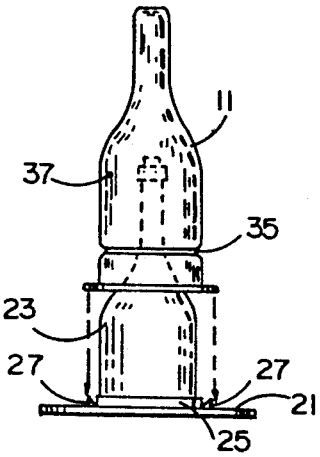
FIGS. 3*a* and 3*b* show various configurations for the shell-like housing.
Figure 3B:
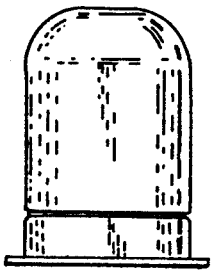

As shown in FIG. 2, housing 11 and balloon 17 can be raised from tray 21 to provide access to the cake 13. Many other articles can also be covered by using a suitably shaped housing. In FIG. 3*a*, a bottle of wine 23 is shown resting on tray 21. In order to keep the bottle of wine positioned on the tray, a suitable support or retaining ring 25 is used. This keeps the bottom of the bottle from sliding along the surface of tray 21. Spaced positioning members 27 are shown on either side of ring 25. Positioning members 27 are used to locate housing 11 on tray 21 and to hold the housing in position relative to bottle 23. Article support 25 and positioning means 27 can be concentric rings, squares or any other configuration designed to function for the intended purpose of holding the article on the tray and the housing in position relative to the article and the tray. Tray 21 can be any type of support member and can, for example, be made of plastic, wood or metal. It can also be in any configuration desired to enhance the appearance of the gift item and the overall appearance of the decorative container. FIG. 3*b* shows another form of housing 11 for use with randomly shaped gift items.

Balloon 17 is preferably a large balloon made of an elastic material. The balloon has an opening or throat portion 29 which has a bead portion 31 about the edge of the opening. The remainder of the balloon is an expandable bag portion 33. It is also within the scope of the present invention to have the balloon preformed and to be merely inflated to the predetermined configuration.

The balloon used as a part of the decorative container can be inflated using either of two negative pressure techniques or a positive pressure technique. In the first negative pressure technique, an enclosure similar to that disclosed by Oyler can be used to remove the air from the space surrounding the balloon allowing the balloon to inflate by ambient air entering through the opened throat of the balloon. When the balloon is fully inflated the housing is inserted in the throat of the balloon to seal the balloon. The housing with attached balloon can then be used to cover an article.

In the second negative pressure technique, the balloon is mounted on a housing which has a sealable opening to allow air to pass into the balloon. Again, the area around the balloon can be evacuated, using an apparatus such as that disclosed in Oyler, allowing ambient air to enter the balloon through the opening in the housing. When the balloon is inflated the aperture is sealed to confine the air in the balloon.

In the positive pressure technique, no enclosure need be evacuated. The balloon is mounted on a housing equipped with a port through which pressurized air, or other harmless gas, can pass to inflate the balloon. When the balloon is inflated, the port is closed sealing the air or gas in the balloon.

In the second negative pressure and positive pressure techniques for inflating the balloon, the balloon 17 is placed over housing 11 with throat portion 29 of the balloon tightly gripping the outer surface of housing 11. The outer surface of the housing can have a recess 35 (FIG. 3*a*) for receiving the bead 31 about the edge of the balloon. The recessed portion helps to hold the balloon in position on housing 11.

Figure 4A:
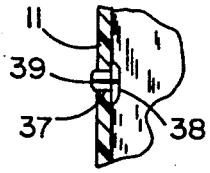
FIGS. 4*a*, 4*b*, 4*c* and 4*d* show different means of sealing the air passage in the decorative housing.
Figure 4B:
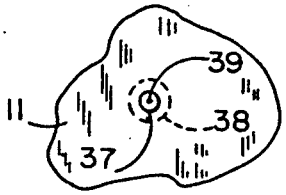

In order to inflate the balloon by either the second negative pressure technique or the positive pressure technique, air must be allowed to pass through housing 11 into balloon 17. For this purpose, an air passage 37 is provided in the wall of housing 11. When the balloon is inflated to the extent desired, air passage 37 is then closed or sealed to maintain the air in the balloon. In FIG. 4*a*, a plug made of a soft rubber or polymeric material is shown inserted into air passage 37. The plug 38 can be solid when used in the negative pressure technique for filling the balloon, or it can have a valve 39 through which a tubular member can pass to inject air into the balloon. For example, a valve similar to the type used on a football or basketball can be mounted in the aperture 37. A needle similar to a so-called football needle can then be passed through the valve 39 to inflate the balloon using a suitable source of air connected to the needle.

Figure 4C:
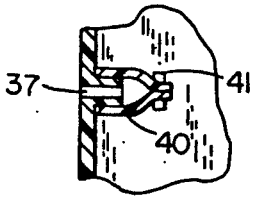

In FIG. 4*c*, a small tubular projection 40 is provided on air passage 37. A suitable clamp 41, such as a pinch clamp, can be used to close the flexible tubulation after the balloon is inflated. Again, the tubulation can be used to allow air to enter the balloon by either the negative or positive pressure technique. In the negative pressure technique, the tubulation would be left open while the space surrounding the balloon is evacuated. In the positive pressure technique, the tubulation would be connected to a suitable source of pressurized air or gas to inflate the balloon With either inflation technique the clamp 41 can be used to close off the tubulation. The balloon can even be inflated by mouth and then tied off. Since the air inside the balloon is isolated by the housing from the article, there is little danger of contamination.

Figure 4D:
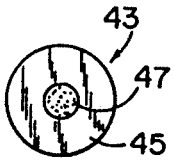

Referring to FIG. 4*d*, a disc of material 43, having a peripheral coating 45 of an adhesive material, can also be used to close air passage 37. The adhesive material will tightly grip the surface of housing 11 about air passage 37 to provide an air-tight seal. The disc 43 can be completely coated with adhesive material or center portion 47 can be left free of adhesive material since it does not have a surface to bind against.

In the first negative pressure technique for inflating the balloon, the housing does not have an aperture for the passage of air. A continuous housing without an air passage to be sealed is preferred. The housing is inserted into the open throat of the inflated balloon to seal the balloon. The aforedescribed enclosure can then be opened to free the balloon now plugged or sealed by the housing part of the decorative container.

Though the invention has been described with respect to a specific preferred embodiment thereof, many variations and modifications will become apparent to those skilled in the art. It is therefore the intention that the appended claims be interpreted as broadly as possible in view of the prior art to include all such variations and modifications.

The embodiments of the invention in which an exclusive property or privilege is claimed are defined as follows.

1. A decorative container comprising:

a housing for removably covering a shaped article; and an elastic balloon on said housing, said balloon enclosing a portion of said housing, said housing closing an aperture in said balloon when said balloon is inflated enabling said housing and inflated balloon to be removed from said article.

2. A decorative container as described in claim 1, wherein said housing has a sealable air passage therein which, when open, allows a harmless gas to enter to inflate said balloon and which, when sealed, confines said harmless gas in said balloon.

3. A decorative container as described in claim 1, wherein said housing has a closed wall which can confine a harmless gas in said balloon when said balloon is inflated.

4. A decorative container as described in claim 3, wherein said housing is made of glass.

5. A decorative container as described in claim 1, wherein said housing is made of an organic polymeric material through which said shaped article can be seen when said housing is in position covering said shaped article.

6. A decorative container as described in claim 1, further including a support means for removably supporting said housing.

7. A decorative container as described in claim 6, further including first positioning means disposed on the surface of said support means for locating said housing on said support means.

8. A decorative container as described in claim 7, further including second positioning means on said support means for locating said article on said support means.

9. A decorative container as described in claim 7, wherein said support means is a tray and said first positioning means releasably positions said housing on said tray.

* * * * *